United States Patent [19]

Nocek et al.

[11] Patent Number: 4,859,083

[45] Date of Patent: Aug. 22, 1989

[54] BAG CHAIN ATTACHED TO COMPUTER PAPER

[75] Inventors: Robert S. Nocek, Stamford, Conn.; Steven Ausnit, New York, N.Y.

[73] Assignee: Minigrip, Inc., Orangeburg, N.Y.

[21] Appl. No.: 41,988

[22] Filed: Apr. 24, 1987

[51] Int. Cl.[4] ..... B65D 30/00

[52] U.S. Cl. ..... 383/37; 229/69; 206/610

[58] Field of Search ..... 383/37; 229/69; 206/610

[56] References Cited

U.S. PATENT DOCUMENTS

| | | | |
|---|---|---|---|
| 2,332,638 | 10/1943 | Heywood | 229/69 |
| 3,033,257 | 5/1962 | Weber | 383/37 |
| 3,554,447 | 1/1971 | Sebring | 229/69 |
| 3,961,743 | 6/1976 | Hollowell | 229/69 |
| 4,084,741 | 4/1978 | Heimann | 229/69 |
| 4,454,980 | 6/1984 | Poehler | 229/73 |
| 4,630,311 | 12/1986 | Bentson | 229/69 |
| 4,726,970 | 2/1988 | Morrish et al. | 383/37 |

FOREIGN PATENT DOCUMENTS

| | | | |
|---|---|---|---|
| 2487784 | 2/1982 | France | 229/69 |

*Primary Examiner*—Willis Little

*Attorney, Agent, or Firm*—Hill, Van Santen, Steadman & Simpson

[57] ABSTRACT

A series of bags having printable areas thereon with the bags secured at their base to a support strip and the support strip is mounted to a continuous support web such as computer paper by a strip of double surfaced adhesive tape supplied between the strip and computer paper with the computer paper thereafter folded to maintain the bags in registry for subsequent printing.

16 Claims, 2 Drawing Sheets

FIG. 1
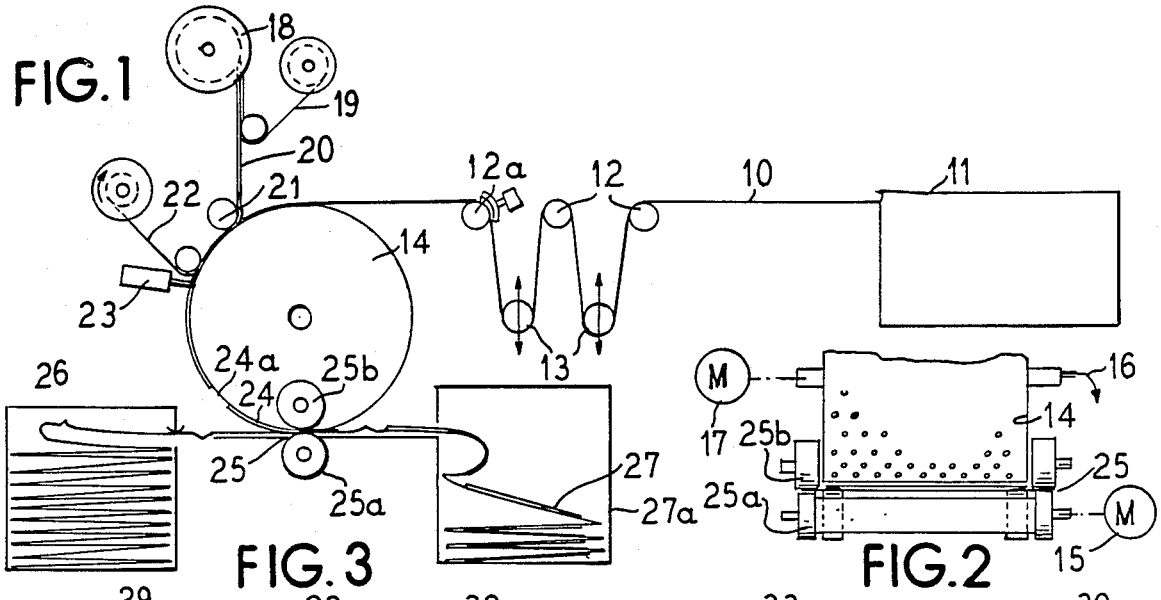
FIG. 3
FIG. 2
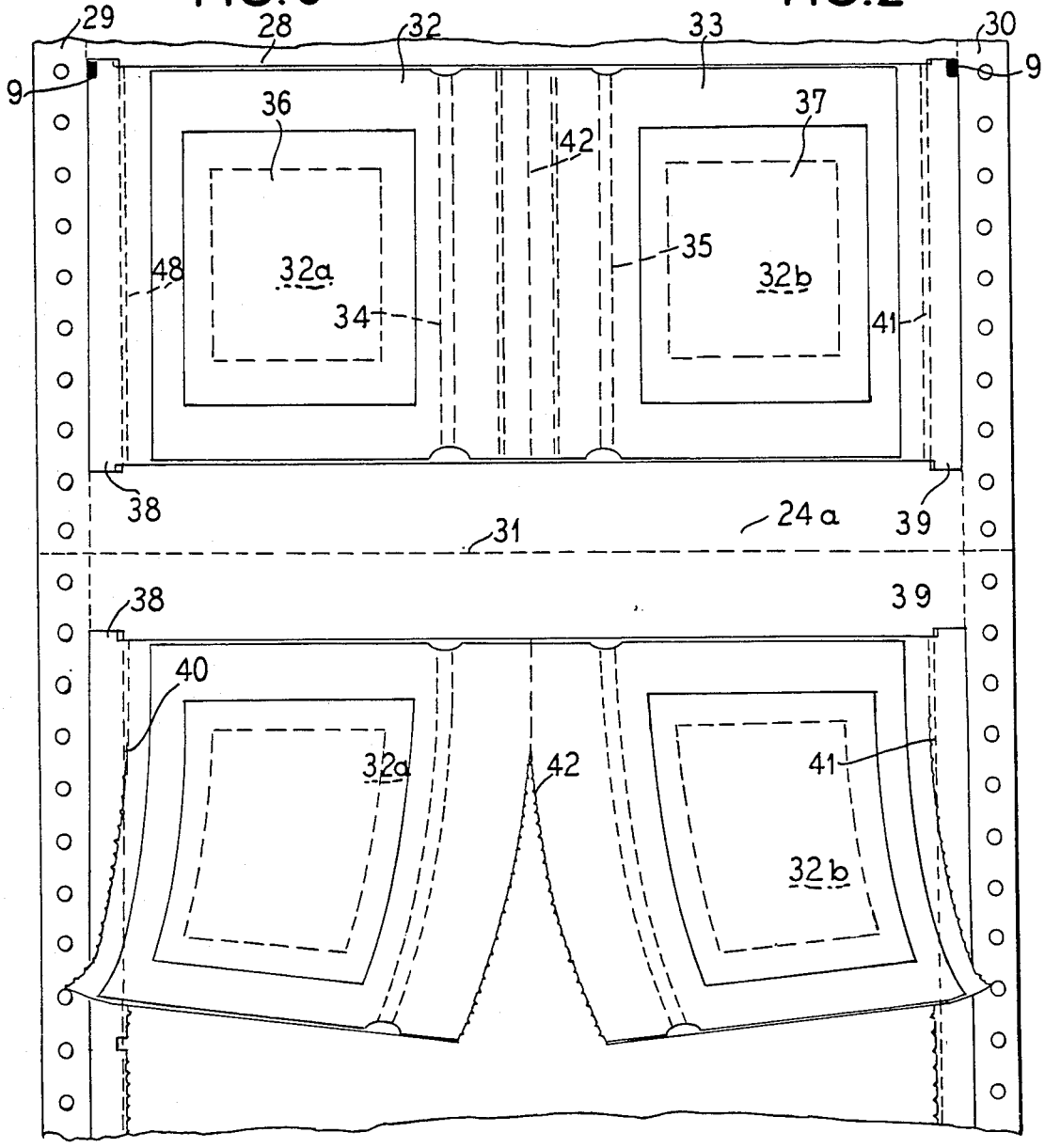

BAG CHAIN ATTACHED TO COMPUTER PAPER

BACKGROUND OF THE INVENTION

The present invention relates to improvements in plastic bags, and more particularly to an apparatus and method and resultant structure wherein a continuous chain of lightweight plastic bags are mounted and held in registry.

More and more operations are being computerized and in the manufacture of thin, lightweight plastic bags, it becomes desirable to controllably handle different product lines. Such handling becomes advantageous and even necessary in maintaining control over the bags for storage, dispensing packing and the like, and one particular special application occurs where the bags have a printable panel on the surface of the bags and the present invention in conjunction with computer print-out equipment makes it possible that a printable panel on the bags can be automatically typed by a computer printer. It is desirable to make a continuous chain of plastic bags and have these chains constructed so that the bags remain in registry and are capable of being received, folded, stored, handled and fed through a computer printer with printing being in registry with a panel on the front of the bag.

One form of bag of this type is formed of polyethylene or similar thin plastic with reclosable fastener strips at the top. The bags are manufactured in sequence and have side seals and end seals and may be formed in a continuous attached chain to be folded or rolled and stored in boxes when the aforesaid printing is not essential. However, when a computer printer is desired, the present invention forms the bags in a continuous chain for storage but in such a manner so that the stored chain can be received by a computer printer with the location of the bags being positive so that printing can occur within the limits of a relatively small panel on the bags. Maintaining the bags in controlled registry is useful for other purposes such as where an indicator mark is carried on the bag to be read by an electric eye or magnetic reader or other automatic reading equipment.

In the manufacture of reclosable bags, normally these are closed at the top by reclosable rib and groove elements while the bottoms are closed either by a fold if before filling or if after filling by a bar or continuous band sealing which heat seals the base of the bag. Another step occurring in the manufacture is the provision of spot seals at the ends of the reclosable rib and groove profiles which reduces the ends within the sealing parameters of the thinner film forming the ends of the bag and maintains the rib and groove profiles in alignment for closing.

It is an object of the present invention to provide an improved continuous bag structure wherein a series of bags are maintained for storage and handling in aligned registry and have the capability of being fed through an electric reader or through a computer printer to print information in a printing panel on one face.

A still further object of the invention is to provide an improved method of making a series of bags which are compatible with computer print-out equipment so that the bag can automatically be typed by a printer with the required information and removed from the chain.

A still further object of the invention is to provide an improved apparatus for the manufacture of bags so that they are attached in registry to the surface of a continuous web of registry insuring support backing such a computer paper and are constructed so that after being printed by a computer printer, they may be individually removed.

FEATURES OF THE INVENTION

A bag chain is manufactured to very critical dimensions and strips of a control web such as paper are attached to the ends of the bag chain with the holes punched in the strips to fit a computer sprocket drive. The control web has a stiffness and non-extensibility characteristic as well as means insuring continued control and registry such as aligning holes along the side of the web. A web such as a paper strip is required since punching holes in the plastic itself would not provide for the exact dimensions necessary. In some instances the support web may be in the nature of strips attached to the edge of the bag with the strips having location control sprocket holes. Accurate lateral dimensioning must be maintained for the paper and sprocket strips, but such edge strips enable feeding through a machine keeping the bags in registry. While strips alone provides a less expensive solution, a preferred solution is the provision of a complete supporting web of material such as computer paper with the thin flexible bags mounted on the surface of the support with a unique fashion.

In the forming of the bags to meet the latter requirement, the bags are preferably formed laterally in sets of two with their top ends adjacent and with the top ends containing the rib and groove reclosable profiles. The bag making process requires first a continuous band sealing of the bottom of the bags to form a support strip and because the bags will have a perforation below the closed bottom. Spot seals are then placed at the end of the profile areas. A perforation is then formed down the center between the bag sets, while additional perforations are formed at the same time which extend beyond the bottom seal on either side of the bag set so that the bag will separate from the web or support strip and the computer paper to which it is later joined. The next step requires a cross-seal to form the bags themselves. A further step may be employed to use an index marker on the bottom sealed area beyond the perforation, which however may not be essential.

The bag chain now is placed on a support web such as computer print-out paper by running the chain around the drum where it is held in place by a vacuum. A two-sided adhesive tape is applied to the sealed area support strip at the base of the bags. The bag assembly is then brought down to an attachment station where it is attached against the continuous support web of computer paper. If the bags are to be separated, the chain is cut into sections by cutting the strip support area and indexed to fit the computer paper or the spacing may be such that the continuous series of bags will be laid on the computer paper. The computer paper is supplied in folded form and will again fold with the bag series firmly registered on the surface. At such time when the bags are used, the computer paper is run through a computer printer and the individual bags removed with the mounting strip left with the computer paper. The adhesive tape used may be of permanent or peelable type on one or both sides or any combination thereof. It may also be desirable to use an adhesive tape down the center of the bag sets to better hold it in position on the computer paper. If the tape used in the center area is not peelable, two sets of perforations rather than one will be needed.

While support is provided for sets of bags that are removably attached to computer paper which has sprocket holes at the side to maintain its orientation, broadly the concept contemplates supporting individual bags or sets of bags on a continuous web which has means for registering the web in passage through a machine, and maintaining the web in registry will permit the proper handling of the bags in cases where the orientation and registration of the bags is important. Sprocket holes are a preferred form of registry of the continuous web but other means may be employed.

Other features, objects and advantages will become more apparent with the teaching of the principles of the invention in connection with the disclosure of the preferred embodiments in the specification, claims and drawings, in which:

DESCRIPTION OF THE DRAWINGS

FIG. 1 is a somewhat schematic view illustrating the procedure in forming a bag chain in accordance with the principles of the present invention;

FIG. 2 is a fragmentary view of a suction drum used to carry the bags down to an attachment station;

FIG. 3 is a plan view of an assemblage wherein the bags are located on computer paper for printing;

DESCRIPTION OF THE PREFERRED EMBODIMENTS

Figures 4, 5:
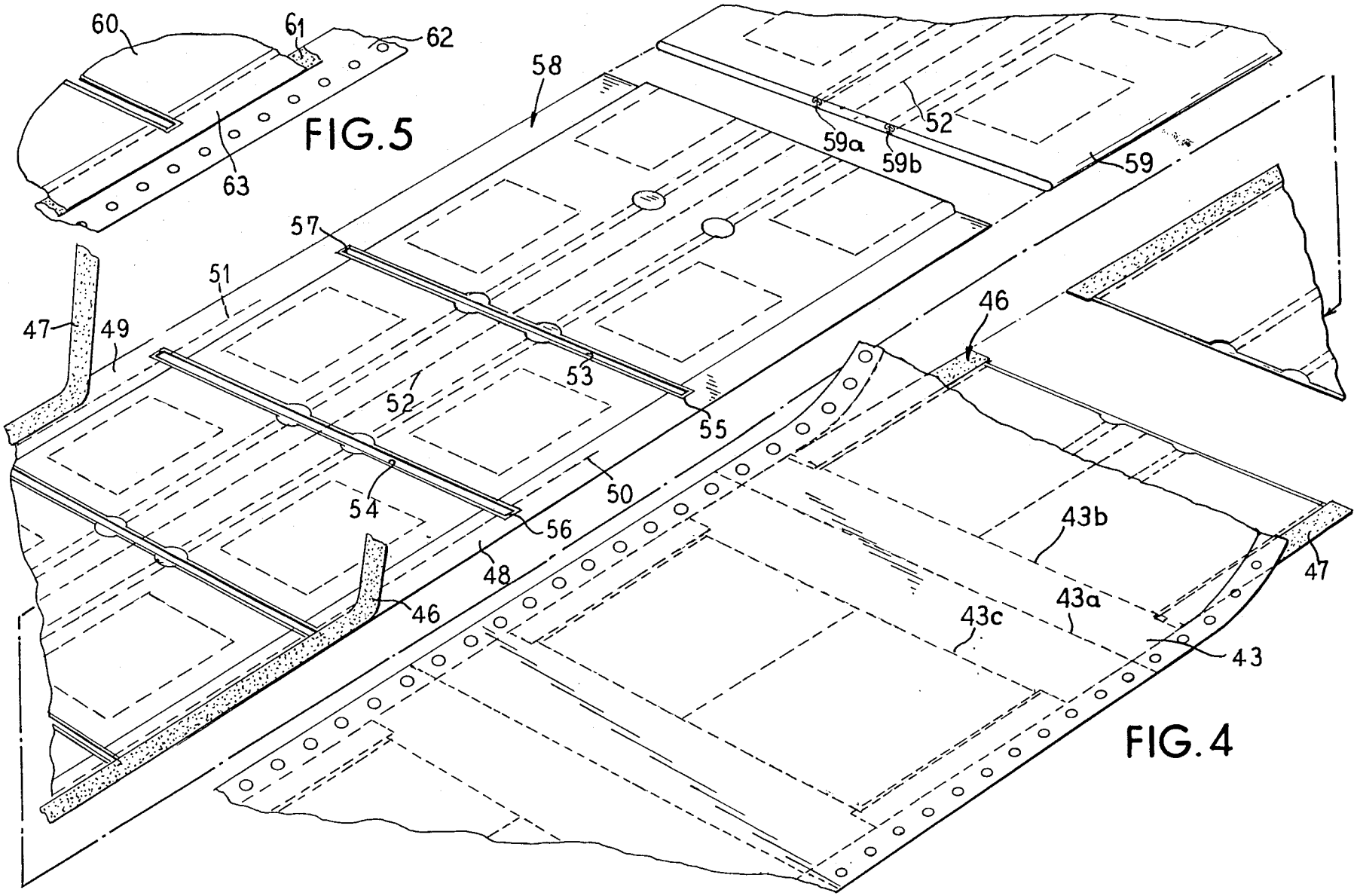
FIG. 4 is a perspective view of bags being processed in accordance with the principles of the invention with the view to be considered sequentially and the top portion of the view illustrating the bags as they begin the process and the bottom portion indicating the bags as the process is being completed.
FIG. 5 is a fragmentary perspective view illustrating a modified form of the invention wherein strips of sprocket computer paper are attached at the edges of the bags.

FIGS. 1 and 2 illustrate a method and mechanism for completing the assembled structure whereas FIGS. 3 through 5 illustrate the structure in different forms and manner in which elements are assembled.

With respect to FIGS. 1 and 2, an endless chain of bags 10 is supplied from a bag machine or a container 11. In accordance with the various manufacturing techniques, the bags are attached to each other such as by a connecting strip along the base of the bags which is the method of attachment illustrated herein. The bags in order to form a chain may be attached by various means and the features of the invention are not to be limited by the manner of attachment of the bags in order to cause them to be interconnected as a chain. The chain of bags 10 is fed over guide rolls 12 and the chain is draped downwardly between the guide rolls with dance rolls 13 forming articulated loops so as to apply a small tension to the chain as it is drawn forwardly, and/or to accommodate differences in speed between the bag machine and the subsequent attachment station.

The bag chain is pulled forwardly by a large suction roll 14 which carries the bags over its surface and brings them downwardly to an attachment station 25 where the bags are joined to a support web such as a supply of computer paper.

The thin flexible bags are mounted for continued registry or continued orientation on a support web which has physical features not possessed by the bags. That is, the bags are limp and flexible and cannot be perforated so as to hold them in accurate registry. A support web or backing web is utilized with the bags temporarily mounted thereon to give them the stiffness and registry necessary for handling them in a continuous web and for maintaining them in registry. The support web may be in the form of strips down the sides or preferably in a continuous support web and material such as computer paper provides a preferred form of support web because it is nonextensible, has registering sprocket holes on the sides, and is sufficiently inexpensive so as to be expendable after providing the necessary function of mounting and holding the bags throughout the time when they are handled, stored and finally given their eventual processing such as placing printing on the surface and individually removed. While it will be understood that other forms of support webbing may be employed, for convenience of reference, the preferred form of the invention will be described utilizing computer paper as the support web material.

On the large feed drum 14, the chain of bags is held tightly to the surface by an internal suction. For this reason, the surface of the roll is provided with perforations, as shown in FIG. 2 and suction means shown schematically at 16 applies a light suction to the interior of the drum 14. The feed drum 14 is driven forwardly by a drive motor 17.

On the surface of the feed drum 14, a double faced tape 20 is applied to the edge of the interconnected bag chain. Before proceeding, reference may be made to FIG. 3 to describe the nature of the finished product. The bags are oriented in registration on the surface of the computer paper and the chain of bags is illustrated as having laterally spaced bags 32 and 33 attached to each other along a tear line 42 at their tops. The bags preferably are of the reopenable and reclosable type having a rib and groove zipper fastener along the tops at 34 and 35 respectively for the bags 32 and 33. On the upper face of the bags is a clear print area 36 and 37 which is to receive computer printing **32*a* and 32*b*** for identification and shipping. The purpose of the attachment of the bag chain to the computer paper is primarily to insure accurate registration and feeding of the bags through the computer printer. Inasmuch as the bags are of a lightweight plastic material which may be on the order of 2 mils thick formed of somewhat stretchable polyethylene or like plastic material, it is essential for their orientation to the computer printer that longitudinal tension in the chain will not stretch out the bags to misorient them for later processing such as the printing process in a computer. By attachment to a paper web of computer paper, orientation is assured and lateral stretching forces will not elongate the bag chain so as to provide improper orientation for marking the bags in the computer.

At the base of the bags is a mounting strip 38 and 39 formed by sealing the base area of the bags and the bags are separable from the mounting strip by perforate tear lines 40 and 41. Attachment of the bags is achieved by securing the mounting strips 38 and 39 to the surface of the computer paper and the continuous web of computer paper is shown at 28 with sprocket side edges 29 and 30. The computer paper has built-in fold lines 31 so that with the bags on the surface, the paper can be folded along these fold lines.

The lower part of FIG. 3 illustrates the manner in which the bags are detached from the computer paper after having been marked. The bags are first detached from their support strips along their base tear lines 40 and 41 and then are detached from each other along the center tear line 42. In some instances it may be desirable to also attach the center of the bags to the computer paper, but this is not essential in the arrangement illustrated.

Returning now to FIG. 1, a continuous supply of computer paper 26 is drawn from a container and fed to the attachment station 25. At the attachment station, the bags 24 are brought down into position on top of the computer paper and attached thereto such as by press rolls 25*a* and 25*b*.

In advance of the attachment station 25, continuous side strips of double faced adhesive 20 are attached to the undersurface of the support strips 38 and 39. The double faced adhesive tape is fed off of a supply roll 18. The double faced adhesive is protected with facing strips which are pulled off with a lower facing strip 19 drawn off in advance of the strip being brought onto the feed drum 14. With their lower adhesive surfaces exposed by withdrawing the protective strips 19, the adhesive strips are pressed against the support strips by a pressure roller 21 and adhere to the support strips 38 and 39 at the base of the bag chain. While FIG. 1 illustrates the pressure roller 21 in side elevation, it will be understood that there will be a pressure roller at each side of the bag strip so that the adhesive tape strips at each side of the bag chain will be attached to the support strips 38 and 39 of the bag chain. Following the attachment of the double faced adhesive strips to the side edges of the bag chain, a protective strip 22 on the outer face of the adhesive strips is removed so that the adhesive will be exposed to attach the bag chain to the surface of the computer paper at the attachment station. Following the removal of the outer strip 22 from the adhesive strips, a cutter 23 is provided. The purpose for this cutter is to sever the support strips 38 and 39 so that a spacing between the bags can be created and the bags can be spaced equally from the fold line 31 as shown in FIG. 3. In some instances, the natural spacing of the bags in the bag chain will be such that it coincides with the spaced fold lines 31 of the computer paper and in that instance the bags need not be spaced.

Two different ways are illustrated for spacing the bags on the computer paper so that groupings of bags lie equally spaced from the fold lines of the computer paper. In one form the bags are separated by a brake 12*a* drawing them apart in conjunction with cooperating rollers and a release of the vacuum holding the bags, and in another more favored form they are separated by a higher speed drive pulling the computer paper faster than the bags are advanced so that spacing occurs between each set of bags. It will be understood that for accurate orientation of the bags on the computer paper, an electric eye mechanism may be employed which will register the tear lines 31 on the computer paper or an index marker such as indicated at 15 and insure that the bags maintain their location where they are centrally located midway between adjacent computer fold and tear lines 31.

A preferred arrangement for causing spacing between the groups of bags to register them properly on the computer paper is to drive the side press rolls 25*a* and 25*b* faster than the drum 14 is driven. Thus, when a set of bags with their adhesive strip are brought down onto the computer paper, the faster moving computer paper will attach itself to the bags only after leaving a space at 25*a* between the trailing end of the bags being attached to the computer paper and the next succeeding set of bags. The drum 14 holding the bag set and the computer paper and the rollers 25*a* and 25*b* can be indexed to provide for the space required depending on the size of the bag set relative to the computer paper As the bags are brought down on the feed drum 14 into the attachment station, the support strips which now have attached the double faced adhesive strip are secured to the surface of the computer paper. For this purpose, press rolls 25*a* and 25*b* are mounted opposite each other at each side of the drum holding the continuous supply of bags and the press rolls firmly apply pressure to the underside of the computer paper and to the upper side of the support strips of the bags so that the double faced adhesive strips secure the support strips 38 and 39 firmly to the computer paper. The resultant web is carried forward as shown at 27 into a container 27*a* where the web 27 is folded back and forth with the fold being formed at the fold lines 31 of the computer paper. The computer paper carrying the firmly attached bags thus can be stored until such time as it is to be fed to the computer printer. At that time, the computer paper is drawn out of the container 27*a* and fed through the computer printer to place the appropriate legends in the spaces 36 and 37 of the bags. Such marking is indicated schematically at 32*a* and 32*b* on the bag surfaces.

Another arrangement is contemplated where instead of a continuous full web of computer paper, side strips with sprocket feed holes adapted for use in a computer printer are attached to the bags. This arrangement is shown in FIG. 5 where groups of bags 60 are self-supporting and the base strips 63 are attached to computer strips 62 by double faced tape 61. The computer strips 62 are provided with sprocket holes so that the assembly can be driven through a printer station of a computer. At the printer station, information will be typed onto the bag faces directly. When the bags are to be removed, they are taken from the computer strips in essentially the same manner as the bags are removed from the full web of computer paper as illustrated in FIG. 3.

FIG. 4 illustrates the sequence of steps which are followed in the preparation and handling of sets of bags in accordance with the principles of the invention. Sets of bags attached to each other are spaced with one set 58 and a succeeding set 59 following. A continuous bag structure is shown at the upper right in FIG. 4 as the bags have been originally made by extrusion. Rib and groove elements at 59*a* and 59*b* have been interlocked and a perforate line 52 has been added down the center. The set of bags is next prepared by sealing and forming side flattened edges or base strips shown at 48 and 58. Thereafter, tear lines 50 and 51 formed part-way in from the edge of the bag are added in the base strips. Separation slots 53 and 54 are then formed, and extend slightly past the tear lines 50 and 51. The bags thus made are divided into sets and each set is of a length so that it will lie between tear lines 43*a* of the computer paper. The group 58 has bags which are arranged in pairs with the top edges of the pairs attached to each other along the dotted tear line 52. The bags are maintained in orientation with respect to each other by base strips 48 and 49 and the bags are attached to these base strips along the lines of weakened tear resistance 50 and 51. As the sets of bags are advanced, the double faced adhesive tapes 46 and 47 are applied to the base strips 48 and 49. After the tapes are applied, the sets of bags are laid upon a continuous web 43 of computer paper. The sets of bags are separated from the fold line 43*a* of the computer paper web as shown by the spacing between edges 43*b* and 43*c* of adjacent bags. The adjacent pairs of bags are separated from each other by the separation slots 53 and 54. These slots extend beyond the bottom of the bag and into the base strip as shown at 56 and 57. As previously described in connection with FIG. 3 when the individual bags are removed, the two opposing bags are torn along lines 50 and 51 and torn off of the base strip 48 and 49, and then separated along line 52.

Thus, it will be seen there has been provided a structure and method and arrangement for providing a continuous bag web which meets the objectives and advantages above set forth and provides a new and unique means for handling and storage of chain bags.

We claim as our invention:

1. A chain-fed multiple bag construction, comprising in combination:

a continuous web of computer paper having sprocket holes at each side;

a plurality of sets of double bags on the surface of the web having printable areas thereon so that the areas can be placed in registry with a printer;

the tops of said bags being in alignment down the center of the web and said adjacent bags attached to each other by lines of weakened tear resistance;

the bottoms of said bags joined by a continuous bag support strip with a line of weakened tear resistance connecting each bag to the strip;

and means securing the strip to the surface of the web laterally inwardly of the sprocket holes so that individual bags can be torn from said strip and be removed from the web after printing is added to the bags.

2. A chain-fed multiple bag construction having the construction of claim 1:

wherein said means for securing the strip is in the form of a continuous double faced tape with one face adhered to the web and the other face adhered to the support strip.

3. A chain-fed multiple bag construction having the construction of claim 1:

wherein successive bags are separated by lines of separation extending laterally across the bags and said lines of separation extend at least to the line of weakened tear resistance joining the supporting strip to the bags.

4. A chain-fed multiple bag construction having the construction of claim 1:

wherein successive bags are spaced from each other.

5. A chain-fed multiple bag construction having the construction of claim 4:

wherein said spacing coincides with laterally extending fold lines formed in said web.

6. A chain-fed multiple bag construction having the construction of claim 1:

wherein the lines of weakened tear resistance are in the form of perforations extending through the bag material.

7. A chain-fed multiple bag construction having the construction of claim 1:

wherein the ends of the bags are sealed inwardly of the lines of weakened tear resistance which connect the bags to the strip.

8. The method of making a continuous series of bags with printable areas thereon capable of being printed by a printer comprising:

feeding a continuous web of computer paper to an attachment station;

feeding an assembly of bags to said station with said bags having a supporting strip attached to said bags by a line of weakened tear resistance;

and supplying an attachment vehicle between said supporting strip and the web whereby the bags will be held in registry on the web for printing and will be removable from said supporting strip.

9. The method of making a continuous series of bags with printable areas thereon capable of being printed by a printer in accordance with the steps of claim 8:

including feeding a double faced tape between the web and the supporting strip for attaching the supporting strip to the web.

10. The method of making a continuous series of bags with printable areas thereon capable of being printed by a printer in accordance with the steps of claim 8:

including severing the bags from each other with a line of severance and extending laterally at least to the edge of the supporting strip so that individual bags can be removed with the strip staying with the web.

11. The method of making a continuous series of bags with printable areas thereon capable of being printed by a printer in accordance with the steps of claim 8:

including longitudinally spacing said bags from each other prior to joining to said web.

12. The method of making a continuous series of bags with printable areas thereon capable of being printed by a printer in accordance with the steps of claim 8:

including cutting sequential bags from each other and creating a space therebetween prior to moving the bags to the attachment station so that the bags will be spaced on the web.

13. An apparatus for making a continuous series of bags with printable areas thereon capable of being printed by a printer, comprising in combination:

means for feeding a continuous web of printer paper through an attachment station;

means for feeding a series of bags interconnected to each other through said station, said bags having a support strip attached thereto by a line of weakened tear resistance;

means feeding an attachment vehicle between the support strip and web in advance of said station so that the bag series will be joined to the computer paper web and printed and be removed from the support strip.

14. An apparatus for making a continuous series of bags with printable areas thereon capable of being printed by a printer in accordance with claim 3:

including a suction drum rotatable for carrying the bags from a receiving location to the attachment station.

15. An apparatus for making a continuous series of bags with printable areas thereon capable of being printed by a printer in accordance with claim 13:

wherein said means for feeding the attachment vehicle supplies a double surfaced adhesive tape.

16. An apparatus for making a continuous series of bags with printable areas thereon capable of being printed by a printer in accordance with claim 15:

wherein said tape is first attached to the support strip and thereafter attached to the continuous web.

* * * * *